US010082002B2

(12) United States Patent
Hulsewe et al.

(10) Patent No.: US 10,082,002 B2
(45) **Date of Patent: *Sep. 25, 2018**

(54) MULTI-STAGE FRACTURING WITH SMART FRACK SLEEVES WHILE LEAVING A FULL FLOW BORE

(71) Applicant: BAKER HUGHES INCORPORATED, Houston, TX (US)

(72) Inventors: Ewoud J. Hulsewe, The Woodlands, TX (US); Edward T. Wood, Kingwood, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 75 days.

This patent is subject to a terminal disclaimer.

(21) Appl. No.: 15/176,858

(22) Filed: Jun. 8, 2016

(65) Prior Publication Data

US 2016/0281464 A1 Sep. 29, 2016

Related U.S. Application Data

(63) Continuation of application No. 14/063,171, filed on Oct. 25, 2013, now Pat. No. 9,546,538.

(51) Int. Cl.
*E21B 34/10* (2006.01)
*E21B 43/26* (2006.01)
(Continued)

(52) U.S. Cl.
CPC ..... *E21B 34/14* (2013.01); *E21B 34/10* (2013.01); *E21B 34/16* (2013.01); *E21B 43/14* (2013.01);
(Continued)

(58) Field of Classification Search
CPC .... E21B 34/14; E21B 43/26; E21B 2034/005; E21B 43/14; E21B 2034/007;
(Continued)

(56) References Cited

U.S. PATENT DOCUMENTS 3,264,994 A 8/1966 Leutwyler
4,729,432 A 3/1988 Helms
(Continued)

FOREIGN PATENT DOCUMENTS

AU 2013318458 A1 3/2015
WO 2013096100 A1 6/2013

OTHER PUBLICATIONS

Baker Oil Tools Advertisement, "What's New From the Leader in Completion Technology", Apr. 1992, 1 page.
(Continued)

*Primary Examiner* — Daniel P Stephenson
(74) *Attorney, Agent, or Firm* — Steve Rosenblatt

(57) ABSTRACT

Fracking ports are initially obstructed with respective biased sleeves that have an associated release device responsive to a unique signal. The signal can be electronic or magnetic and delivered in a ball or dart that is dropped or pumped past a sensor associated with each release device. Each sensor is responsive to a unique signal. When the signal is received the release device allows the bias to shift the sleeve to open the fracture port and to let a flapper get biased onto an associated seat. The flapper and seat are preferably made from a material that eventually disappears leaving an unobstructed flow path in the passage. The method calls for repeating the process in an uphole direction until the entire zone is fractured. The flapper and seat can dissolve or otherwise disappear with well fluids, thermal effects, or added fluids to the well.

38 Claims, 1 Drawing Sheet

(51) Int. Cl.

| | |
|---|---|
| ***E21B 34/14*** | (2006.01) |
| ***E21B 34/16*** | (2006.01) |
| ***E21B 43/14*** | (2006.01) |
| *E21B 34/00* | (2006.01) |

(52) U.S. Cl.
CPC ..... *E21B 43/26* (2013.01); *E21B 2034/005* (2013.01); *E21B 2034/007* (2013.01)

(58) Field of Classification Search
CPC ..... E21B 34/06; E21B 34/063; E21B 34/10; E21B 21/10; E21B 21/103; E21B 23/04
See application file for complete search history.

(56) References Cited

U.S. PATENT DOCUMENTS

| | | | |
|---|---|---|---|
| 4,893,678 | A | 1/1990 | Stokley et al. |
| 5,070,944 | A | 12/1991 | Hopper |
| 6,675,909 | B1 | 1/2004 | Cowart et al. |
| 7,287,596 | B2 | 10/2007 | Frazier et al. |
| 7,322,417 | B2 | 1/2008 | Rytlewski et al. |
| 7,350,582 | B2 | 4/2008 | McKeachnie et al. |
| 7,624,809 | B2 | 12/2009 | Frazier et al. |
| 7,637,317 | B1 | 12/2009 | Hernandez et al. |
| 7,798,229 | B2 | 9/2010 | Vick, Jr. et al. |
| 7,798,236 | B2 | 9/2010 | McKeachnie et al. |
| 7,909,102 | B1 | 3/2011 | Hernandez et al. |
| 7,926,571 | B2 | 4/2011 | Hofman |
| 8,167,048 | B1 | 5/2012 | Hernandez et al. |
| 2007/0204995 | A1 | 9/2007 | Hofman et al. |
| 2007/0272411 | A1 | 11/2007 | Lopez et al. |
| 2007/0272413 | A1 | 11/2007 | Rytlewski et al. |
| 2009/0065194 | A1 | 3/2009 | Frazier |
| 2010/0230109 | A1 | 9/2010 | Lake et al. |
| 2010/0243269 | A1 | 9/2010 | Solhaug et al. |
| 2011/0136707 | A1 | 6/2011 | Xu et al. |
| 2011/0209873 | A1 | 9/2011 | Stout |
| 2011/0284232 | A1 | 11/2011 | Huang |
| 2012/0085548 | A1 | 4/2012 | Fleckenstein et al. |
| 2013/0014859 | A1 | 1/2013 | Friedlich |
| 2013/0014941 | A1 | 1/2013 | Tips et al. |
| 2013/0048290 | A1 | 2/2013 | Howell et al. |
| 2014/0041876 | A1 | 2/2014 | Fleckenstein et al. |
| 2015/0114664 | A1 | 4/2015 | Hulsewe et al. |

OTHER PUBLICATIONS

Hopmann, Mark, et al., "Electronically Enhanced Remote-Actuation Systems Improve Deepwater Completions and Capabilities," SPE 36995, 1996; SPE Drilling & Completion, Dec. 1997, 224-227.

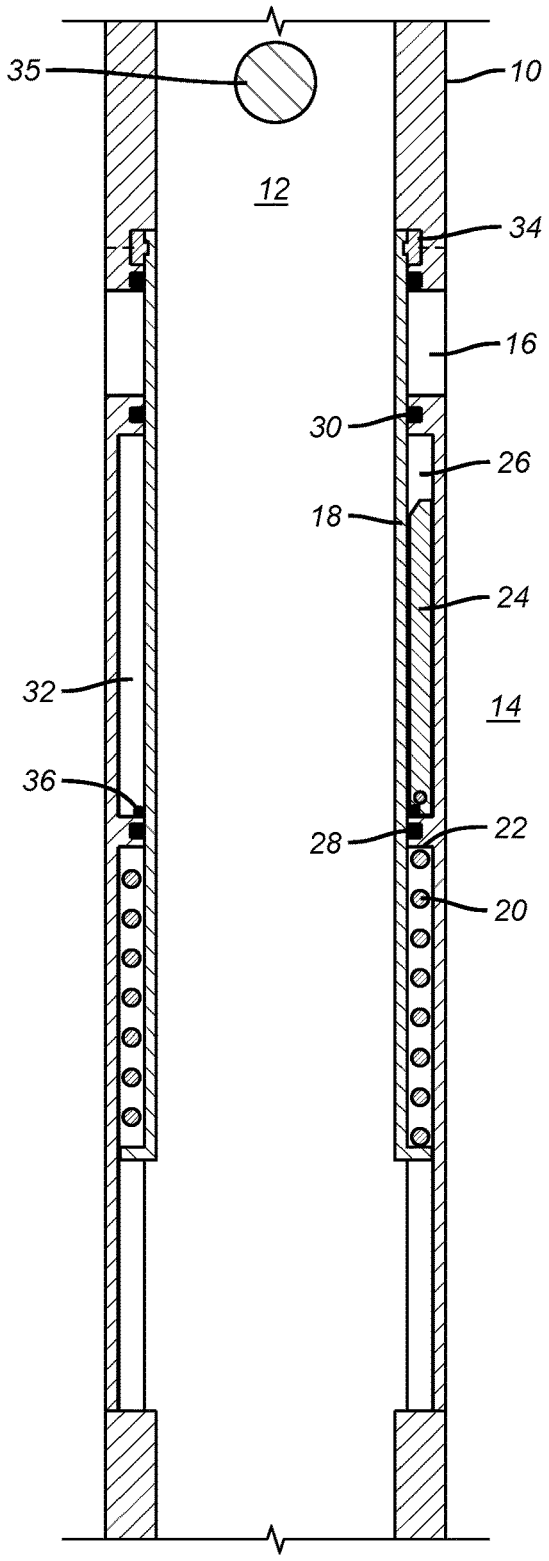
35
10
12
34
16
30
26
18
24
32
14
36
28
22
20

MULTI-STAGE FRACTURING WITH SMART FRACK SLEEVES WHILE LEAVING A FULL FLOW BORE

PRIORITY INFORMATION

This application is a continuation of U.S. patent application Ser. No. 14/063,171 filed on Oct. 25, 2013.

FIELD OF THE INVENTION

The field of the invention is multi-stage fracturing where ports are sequentially opened as the borehole below is isolated so that high pressure fluid can be directed to the formation to initiate fractures and more particularly to methods and devices that permit a full bore for subsequent production and remediation.

BACKGROUND OF THE INVENTION

In typical multi-stage fractures progressively larger balls are landed on a series of ball seats going in a direction from downhole to uphole. The dropped or pumped ball finds its respective seat and pressure that is built up on the seated ball shifts a sliding sleeve to open an adjacent wall port. With the borehole below isolated by the seated ball the fracking through the open port can begin. When the fracking through that port is completed another and slightly larger ball is dropped onto the next ball seat up which effectively isolates the open port below and the process is repeated in stages until the zone is completed. One issue with these systems is that the borehole tubulars can only accept so many different sized balls that have to be stored at the surface very carefully to be sure they get dropped in the right order. Another issue is that the presence of all the ball seats is a flow obstruction to later production. Of course the balls could be allowed to come back to the surface with production but the ball seats remain behind. Another approach would be to mill out the balls and seats before producing but that produces debris that has to be removed and is expensive and time consuming.

More recently, controlled electrolytic materials have been described in US Publication 2011/0136707 and related applications filed the same day. The related applications are incorporated by reference herein as though fully set forth. The listed published application specification and drawings are literally included in this specification to provide an understanding of the materials considered to be encompassed by the term "controlled electrolytic materials" or CEM for short.

Fracking systems that use flappers are illustrated in U.S. Pat. Nos. 7,909,102; 8,167,048; 7,637,317; 7,624,809; 7,287,596 and 2011/0209873. Some of these techniques use shifting tools or pressure on the closed flapper to shift a sleeve to allow access to a frack port.

The present invention seeks to take advantage of such materials to solve the issues discussed above with prior fracturing techniques. At each fracking location an assembly of a sleeve that can be triggered with a rapidly deployed signal can be moved when desired to not only expose a frack port but to also allow a closure to move to a closed position for the borehole so that fracking can begin from the now closed passage. By making the closure and its associated seat from CEM or another material that can selectively disappear, the problem of subsequent production passage impediments from the seats or the closures are eliminated because the closures and seats simply disappear. The preferred closure is a sprung flapper that can be protected from well fluids until the associated sleeve is operated. Both the flapper and the associated seat can be made from CEM or some other material that over time fails or disappears in well fluids. The sleeve can be held against a bias force that is released with the delivered signal. The signal can be delivered electrically, magnetically or through electro-magnetic pulse or with a ball, dart or other device that sends a signal specific to a given stage in the series of sleeves so that the sleeves get operated in the desired sequence. Using a ball or dart that is dropped and/or pumped gets the signal to the destination quicker. As a result production can start sooner in a string that is not partially obstructed with ball seats so that a higher production rate can be attained and the need for drilling out ball seats is eliminated. Those skilled in the art will more readily appreciate other aspects of the invention from a review of the description of the preferred embodiment and the associated drawing while recognizing that the full scope of the invention is to be found in the appended claims.

SUMMARY OF THE INVENTION

Fracking ports are initially obstructed with respective biased sleeves that have an associated release device responsive to a unique signal. The signal can be electronic, magnetic or electro-magnetic pulse and delivered in a ball or dart or other device that is dropped or pumped past a sensor associated with each release device. Each sensor is responsive to a unique signal. When the signal is received the release device allows the bias to shift the sleeve to open the fracture port and to let a flapper get biased onto an associated seat. The flapper and seat are preferably made from a material that eventually disappears leaving an unobstructed flow path in the passage. The method calls for repeating the process in an uphole direction until the entire zone is fractured. The flapper and seat can dissolve or otherwise disappear with well fluids, thermal effects, or added fluids to the well.

BRIEF DESCRIPTION OF THE DRAWING

The FIGURE illustrates the run in position at a given frack port before the sleeve is shifted.

DETAILED DESCRIPTION OF THE PREFERRED EMBODIMENT

Referring to the FIGURE a tubular string 10 is in a wellbore and has a passage 12 therethrough. Surrounding the string 10 is the formation 14 to be fractured. There may also be cement surrounding the tubular through which the fracturing can take place but such cement is not shown. A frack port 16 is shown and it is blocked by sleeve 18 for running in. The sleeve is biased to the open position by a spring 20 pushing off of shoulder 22 on the string 10. The sleeve 18 can be alternatively actuated with hydrostatic pressure, a shifting tool, stored compressed gas, a stepper motor or other source of potential or other energy. A flapper 24 is in a chamber 26 that is isolated by seals 28 and 30. The chamber 26 can be filled with an inert material 32 to provide a longer period of protection from well fluids once the sleeve 18 is allowed to shift under the bias force of spring 20. The sleeve 18 is released to move when sensor 34 gets a coded signal unique to sensor 34 to release the sleeve 18. An object such as a ball or a dart 35 has incorporated within a signal generating capability such that on close proximity on the way past the sensor 34 the signal is processed to release the sleeve 18 so that it can shift under the bias of spring 20. As the sleeve moves down the port or ports 16 are opened and the flapper 24 is free to rotate counterclockwise until it falls onto seat 36 as the sleeve 18 descends below seat 36. Both the flapper 24 and the seat 36 are exposed to well fluids at this time, however, pressure in passage 12 can be immediately applied to frack the formation through open port 16 before sealing integrity is lost through the dissolving or other disappearing process that makes the flapper 24 and the associated seat 36 ultimately disappear to leave a clear passage 12 for later production flow.

Those skilled in the art will appreciate that a given string has a series of assemblies as illustrated in the FIGURE and that the process repeats in an uphole direction until the entire interval is fracked. With each higher location or location closer to the wellhead, the already fracked openings 16 that stay open are isolated by a flapper that is above that is triggered with another object giving another unique signal to move the next adjacent assembly as in the FIGURE so the process can continue. With the flapper and seat being preferably of CEM, after a predetermined time of exposure to well conditions or fluids added to the well the flapper and seat break up and fall to the bottom of the hole or are brought to the surface with production. The production flow path 12 is however, free of obstruction from flappers that have to be pushed up and out of the way as well as the seats that restrict flow by presenting a peripheral annular object in the flow stream during the production phase. The length of time for the failure and removal of the flapper and associated seat can vary. It can happened at or after the next flapper in the direction toward the surface has been triggered to close or at a later time when the entire interval has already been fracked up to or after the time production or injection is set to commence. The production fluids or injection fluids can trigger the failure and removal of the flapper and the associated seat.

Although flappers are indicated as the blocking device and are preferred because they are simple in design and very economical, other devices to block the production flow passage are envisioned. For example, the variety of different sized balls or darts that land on seats can be used and made of a material that goes away or dissolves and the same result can be obtained. The balls or darts can have a signal transmitter that is picked up by a sensor to release a biased sleeve to open the fracking port. Alternatively, electromagnetic pulsing through the tubular string can be used for triggering the sleeve and flapper to close. Alternatively the seat can be integrated with the sleeve so that pressure buildup on the seated object can shift the seat with the sleeve.

The signal type can be radioactive, magnetic, electrical, electro-magnetic or mechanical. The sleeve movement can be driven with different types of bias such as a compressed gas reservoir, hydrostatic pressure either from the passage or the surrounding annulus or different types of springs other than coiled springs.

The sleeve can also be equipped for bi-directional movement so that after the fracking the production or injection can be sequenced or parts of the interval closed off as desired. The sleeve return movement to close the associated port can be done in a variety of ways such as a motor driven rack and pinion system, pressure cycle responsive j-slots or sleeve shifting tools to name a few options. Detents can also be provided to hold the sleeve in the open position after release to open with a signal as described above or to again retain the sleeve in the port closed position after the initial opening.

The above description is illustrative of the preferred embodiment and many modifications may be made by those skilled in the art without departing from the invention whose scope is to be determined from the literal and equivalent scope of the claims below.

We claim:

1. A method for treating an interval in a subterranean location, comprising:

running in a tubular string with a plurality of axially spaced wall ports and valve assemblies associated with said plurality of wall ports;

using said selected valve assemblies at said plurality of wall ports to sequentially open said wall ports while sequentially closing off, with a closure device, a passage in said tubular string adjacent to said sequentially opened wall ports;

shifting said valve assemblies with released potential energy, said shifting activating said closure device;

sequentially treating the interval through said ports;

configuring said closure devices to fail and be removed from said passage without intervention in said passage.

2. The method of claim 1, comprising:

providing uniquely configured sensors with said valve assemblies that respond to discrete signals for actuating a discrete said valve assembly to open said associated said wall port and close said passage adjacent to said opened wall port.

3. The method of claim 2, comprising:

having said sensors respond to a signal transmitter delivered in close proximity and carried by an object dropped or pumped into said passage or pulsed through the tubular string.

4. The method of claim 3, comprising:

making said object a ball or a plug.

5. The method of claim 2, comprising:

making said sensors respond to at least one of an electrical, magnetic, acoustic radioactive, electro-magnetic or chemical signal.

6. The method of claim 1, comprising:

using a sliding sleeve to both open a predetermined said wall port and close said passage with a nearest said closure device.

7. The method of claim 6, comprising:

using said sliding sleeve to close said port after opening said port.

8. The method of claim 1, comprising:

making said closure device from CEM.

9. The method of claim 1, comprising:

isolating said closure device from well fluid until said closure device is deployed to block said passage.

10. The method of claim 9, comprising:

using a sliding sleeve for said isolating.

11. The method of claim 10, comprising:

defining a sealed annular space between said sliding sleeve and said tubular string for retaining said closure device out of said passage.

12. The method of claim 11, comprising:

providing an inert material in said annular space for further protection of said closure device from well fluid.

13. The method of claim 11, comprising:

using a flapper for said closure device that swings onto a seat when said sliding sleeve moves.

14. The method of claim 10, comprising:

providing as said released potential energy at least one of a spring, compressed gas, and hydrostatic pressure in said passage.

15. The method of claim 14, comprising:

releasing a force from a compressed said spring to move said sliding sleeve.

16. The method of claim 15, comprising:

using a sensor for release of said compressed spring for moving said sliding sleeve.

17. The method of claim 16, comprising:

making said sensors respond to at least one of an electrical, magnetic, acoustic radioactive, electro-magnetic or chemical signal.

18. The method of claim 17, comprising:

using a flapper for said closure device that pivots onto an associated seat in said passage on movement of said sliding sleeve.

19. The method of claim 18, comprising:

making said flapper and seat disappear from said passage from exposure to well conditions.

20. The method of claim 19, comprising:

producing through said passage without said flapper or seal in said passage to provide a flow restriction.

21. The method of claim 19, comprising:

making said flapper and seat from CEM.

22. The method of claim 1, comprising:

configuring said closure device to fail and be removed from said passage when another said closure device is in the position of closing off said passage.

23. The method of claim 1, comprising:

shifting said valve assemblies in a downhole direction.

24. A treatment apparatus for a formation through a borehole, comprising;

a tubular housing having a passage therethrough and at least one wall port;

a valve member selectively covering said at least one wall port and selectively movable to open said at least one port with a potential energy force, wherein movement of said valve member actuates a previously stationary closure for initial movement for closing off said passage for communicating fluid between said passage and the formation.

25. The apparatus of claim 24, wherein:

said closure comprises a flapper.

26. The apparatus of claim 24, wherein:

said potential energy source further comprises at least one of a spring, compressed gas, and hydrostatic pressure in said passage.

27. The apparatus of claim 24, wherein:

said closure device is isolated from well fluid until said closure device is deployed to block said passage.

28. The apparatus of claim 24, wherein:

said valve member movable in an opposite direction than said movement that opened said at least one wall port to close said at least one port after opening said at least one port.

29. A treatment apparatus for a formation through a borehole, comprising;

a tubular housing having a passage therethrough and at least one wall port;

a valve member selectively covering said at least one wall port and selectively movable to open said at least one port with a potential energy force, wherein movement of said valve member actuates a closure for closing off said passage for communicating fluid between said passage and the formation;

said valve member comprises a sliding sleeve.

30. The apparatus of claim 29, wherein:

said closure comprises a flapper;

movement of said sliding sleeve allows said flapper to rotate into contact with a seat.

31. The apparatus of claim 30, wherein:

making said flapper and seat from a material that is removed from said passage upon a predetermined exposure to well fluids.

32. The apparatus of claim 31, wherein:

making said flapper and said seat from CEM.

33. The apparatus of claim 29, wherein:

said valve member lockable with after opening said at least one port.

34. A treatment apparatus for a formation through a borehole, comprising;

a tubular housing having a passage therethrough and at least one wall port;

a valve member selectively covering said at least one wall port and selectively movable to open said at least one port with a potential energy force, wherein movement of said valve member actuates a closure for closing off said passage for communicating fluid between said passage and the formation;

said closure is disposed in an annular space defined between said valve member and a wall that defines said passage.

35. The apparatus of claim 34, further comprising:

an inert material in said annular space for further protection of said flapper from well fluid.

36. A treatment apparatus for a formation through a borehole, comprising;

a tubular housing having a passage therethrough and at least one wall port;

a valve member selectively covering said at least one wall port and selectively movable to open said at least one port with a potential energy force, wherein movement of said valve member actuates a closure for closing off said passage for communicating fluid between said passage and the formation;

said potential energy is released using a sensor responsive to at least one of an electrical, magnetic, acoustic radioactive, electro-magnetic or chemical signal.

37. The apparatus of claim 36, wherein:

said sensor responds to a signal transmitter delivered in close proximity and carried by an object dropped, pumped or delivered into said passage or pulsed through the tubular string.

38. The apparatus of claim 37, wherein:

said object comprises a ball or a dart.

* * * * *